US005601019A

United States Patent [19]

Ohinata et al.

[11] Patent Number: 5,601,019

[45] Date of Patent: Feb. 11, 1997

[54] ROTARY STENCIL PRINTER HAVING GEAR TRAIN FOR SYNCHRONIZING INNER PRESS ROLLER WITH PRINTING DRUM AND INCLUDING BRAKE FOR PRESS BIAS CONTROL

[75] Inventors: Yoshiharu Ohinata; Yasuhiro Takahashi; Yoshihiro Noguchi, all of Minato-ku, Japan

[73] Assignee: Riso Kagaku Corporation, Tokyo, Japan

[21] Appl. No.: 567,163

[22] Filed: Dec. 5, 1995

[30] Foreign Application Priority Data

Dec. 8, 1994 [JP] Japan ..... 6-331071
Mar. 28, 1995 [JP] Japan ..... 7-094325

[51] Int. Cl.[6] ..... B41L 13/04

[52] U.S. Cl. ..... 101/129; 101/116; 101/119; 101/120

[58] Field of Search ..... 101/116, 117, 101/120, 118, 119, 129

[56] References Cited

U.S. PATENT DOCUMENTS 5,081,924 1/1992 Ohinata et al. ..... 101/116
5,454,308 10/1995 Sato et al. ..... 101/119
5,501,146 3/1996 Yamanaka et al. ..... 101/116
5,507,225 4/1996 Noguchi et al. ..... 101/116
5,517,913 5/1996 Oshio et al. ..... 101/119

FOREIGN PATENT DOCUMENTS 1-204781 8/1989 Japan .
2-225078 9/1990 Japan .
3-254984 11/1991 Japan .
2241672A 9/1991 United Kingdom .

*Primary Examiner*—Eugene H. Eickholt
*Attorney, Agent, or Firm*—Oliff & Berridge

[57] ABSTRACT

The rotation of the inner press roller 16 is synchronized with the rotation of the printing drum 10 by the gear train including a gear wheel 22 coaxial with the printing drum, a gear wheel 24 meshing with the gear wheel 22 and rotatably supported by an arm 26 swingable about the central axis of the printing drum, and a gear wheel 28 meshing with the gear wheel 24 and coaxially connected with the inner press roller 16 to rotate therewith and rotatably supported by an arm 18 swingable about a pivot axis Ob parallel with and distant from the central axis Oa of the printing drum. In the gear train, a brake 86 or 90 is provided for braking the gear wheel 28 or 24 to control the biasing out operation of the inner press roller 12 against the circumferential wall 12 of the printing drum. The braking action may be temporarily increased during a starting up of the printing operation. The distance between the axes of the gear wheels 24 and 28 may desirably be restricted not to increase beyond a predetermined distance.

7 Claims, 8 Drawing Sheets

ROTARY STENCIL PRINTER HAVING GEAR TRAIN FOR SYNCHRONIZING INNER PRESS ROLLER WITH PRINTING DRUM AND INCLUDING BRAKE FOR PRESS BIAS CONTROL

BACKGROUND OF THE INVENTION

1. Field of the Invention

The present invention relates to a rotary stencil printer, and more particularly to a construction for operating an inner press roller of a rotary stencil printer in which a part of a cylindrical wall made of an ink permeable flexible sheet material of a printing drum is pressed radially outward by the inner press roller from the inside thereof during a printing operation, and a method of controlling the operation of the inner press roller.

2. Description of the Prior Art

As a type of rotary stencil printer there has been proposed in Japanese Patent Laid-open Publication 1-204781 filed by the same assignee as the present application a rotary stencil printer having a basic construction which comprises a printing drum having an ink permeable flexible circumferential wall, a back press roller opposing the printing drum at an outside thereof in close proximity thereto, and an inner press roller for selectively pressing a part of the circumferential wall of the printing drum from the inside thereof radially outward toward the back press roller, wherein the inner press roller is supported to be rotatable on a central axis thereof by an arm means adapted to swing around a pivot axis parallel with and distant from a central axis of the printing drum, so that when the arm means is positioned at a first swing position around the pivot axis, the inner press roller is just in contact with or apart from the circumferential wall of the printing drum, while when the arm means is at a second swing position around the pivot axis, the inner press roller presses a part of the circumferential wall of the printing drum radially outward toward the back press roller, so that when a stencil is mounted around the circumferential wall of the printing drum and the printing drum is rotated in synchronization with the back press roller in mutually opposite rotational directions with the part of the circumferential wall of the printing drum being pressed radially outward by the inner press roller toward the back press roller, a print sheet fed into a nipping region defined between the opposing portions of the printing drum and the back press roller is applied with a print image according to the perforations of the stencil by ink supplied to the inside of the printing drum. Further, there has been proposed in Japanese Patent Laid-open Publication 2-225078 filed by the same assignee as the present application a rotary stencil printer having the above-mentioned basic construction and improved with respect to the ink permeable flexible circumferential wall of the printing drum.

Further, there has been proposed in Japanese Patent Laid-open Publication 3-254984 filed by the same assignee as the present application a rotary stencil printer which has the above-mentioned basic construction and further incorporates a gear train for synchronizing the rotation of the inner press roller with the rotation of the printing drum, so that the inner press roller is positively rotated, instead of being rotated by following the rotation of the printing drum due a frictional contact therewith via a viscous ink layer, at a distinctly predetermined rotation ratio relative to the rotation of the printing drum, thereby stabilizing the squeezing action applied to the circumferential wall of the printing drum by the inner press roller, and also biasing the inner press roller radially outward against the circumferential wall of the printing drum by a force transmitted to the inner press roller through the gear train. In this rotary stencil printer, however, although the stability of the squeezing action is highly improved as the rotation of the inner press roller is definitely synchronized to the rotation of the printing drum by the gear train, the force transmitted to the inner press roller through the gear train is not necessarily stabilized.

SUMMARY OF THE INVENTION

In view of the above-mentioned problem in the rotary stencil printer having the gear train for synchronizing the rotation of the inner press roller with that of the printing drum for regulating the grade of squeezing action applied by the inner press roller to the circumferential wall of the printing drum, it is a primary object of the present invention to provide an improved rotary stencil printer in which the force for pressing the inner press roller radially outward against the circumferential wall of the printing drum is optionally controlled by a control of the flow of force transmitted through the gear train for synchronizing the rotation of the inner press roller with that of the printing drum so that the printing pressure of the stencil printing is optionally controlled.

It is a further object of the present invention to further improve the rotary stencil printer of the above-mentioned construction so that the flow of force through the gear train is controllable at wider variety.

It is a further object of the present invention to further improve the rotary stencil printer of the above-mentioned construction so that the flow of force through the gear train is more stabilized at the controlled condition.

It is a further object of the present invention to further improve the rotary stencil printer of the above-mentioned construction so that the force of pressing the inner press roller outward is more uniformly controlled over the whole width of the inner press roller.

It is a still further object of the present invention to provide a particularly desirable method of controlling the operation of the rotary stencil printer of the above-mentioned construction so that the thickness of the print image is uniformly ensured from the very beginning of the start of printing operation.

According to the present invention, the above-mentioned primary object is accomplished by a rotary stencil printer comprising:

a frame body;

a printing drum having a circumferential wall made of an ink permeable flexible sheet material and supported by the frame body to be rotatable on a central axis thereof;

a back press roller having a cylindrical outer surface and supported by the frame body to be rotatable on a central axis thereof parallel with the central axis of the printing drum so as to define a nip region between the cylindrical outer surface thereof and a cylindrical outer surface of the printing drum for nipping and transferring a print sheet therethrough;

a first arm means supported by the frame body to swing about a pivot axis thereof parallel with and distant from the central axis of the printing drum;

an inner press roller supported by said first arm means to be rotatable on a central axis thereof parallel with and distant from the pivot axis of said first arm means to contact a part of the circumferential wall of the printing drum at a radially inside surface thereof so as to selectively press said part radially outward of the printing drum toward the back press roller when biased in a radially outward direction of the printing drum;

a first gear wheel adapted to rotate on the central axis of the printing drum in synchronization with the printing drum;

a second arm means adapted to swing about the central axis of the printing drum;

a second gear wheel supported by said second arm means to be rotatable about a central axis thereof and meshing with said first gear wheel;

a third gear wheel adapted to rotate about the central axis of the inner press roller together therewith and meshing with said second gear wheel so that the inner press roller is rotated in synchronization with the printing drum through a gear train of said first, second and third gear wheels when the printing drum is driven to rotate on the central axis thereof; and a brake means for braking rotation of at least one of said second and third gear wheels against the corresponding support arm means so that a reaction torque generated by an actuation of the brake means generates a force to bias the inner press roller in said radially outward direction of the printing drum.

In the rotary stencil printer of the above-mentioned basic construction, the central axis of said second gear wheel may be located on a first side of a phantom plane extended between the central axes of the printing drum and the inner press roller opposite to a second side thereof at which the pivot axis of said first arm means is located.

Or, in the rotary stencil printer of the above-mentioned basic construction, the central axis of said second gear wheel may be located on a same side of the phantom plane extended between the central axes of the printing drum and the inner press roller as the pivot axis of said first arm means, and said brake means brakes the rotation of said third gear wheel.

The rotary stencil printer of the above-mentioned basic construction may further comprise a means for restricting a distance between the central axes of said second and third gear wheels from increasing beyond a predetermined distance to ensure a designed meshing therebetween.

It is more desirable that in the rotary stencil printer of the above-mentioned construction, said third gear wheel is provided as a pair of gear wheels at opposite ends of the inner press roller, and said first and second gear wheels and said first and second arm means are each provided as a pair corresponding to said third gear wheels, wherein means are provided to connect each pair of said pairs of first and second arm means with one another so that each pair of said pairs of first and second arm means swing together about the corresponding pivot axis.

When the rotary stencil printer of the above-mentioned basic construction is operated, the brake means may be operated to control the biasing of the inner press roller in said radially outward direction of the printing drum of the rotary stencil printer such that the brake is temporarily more strongly actuated during a-starting up of printing operation of the printer than in a normal operating condition thereof.

BRIEF DESCRIPTION OF THE DRAWING

In the accompanying drawing.

DESCRIPTION OF THE PREFERRED EMBODIMENTS

Figure 1:
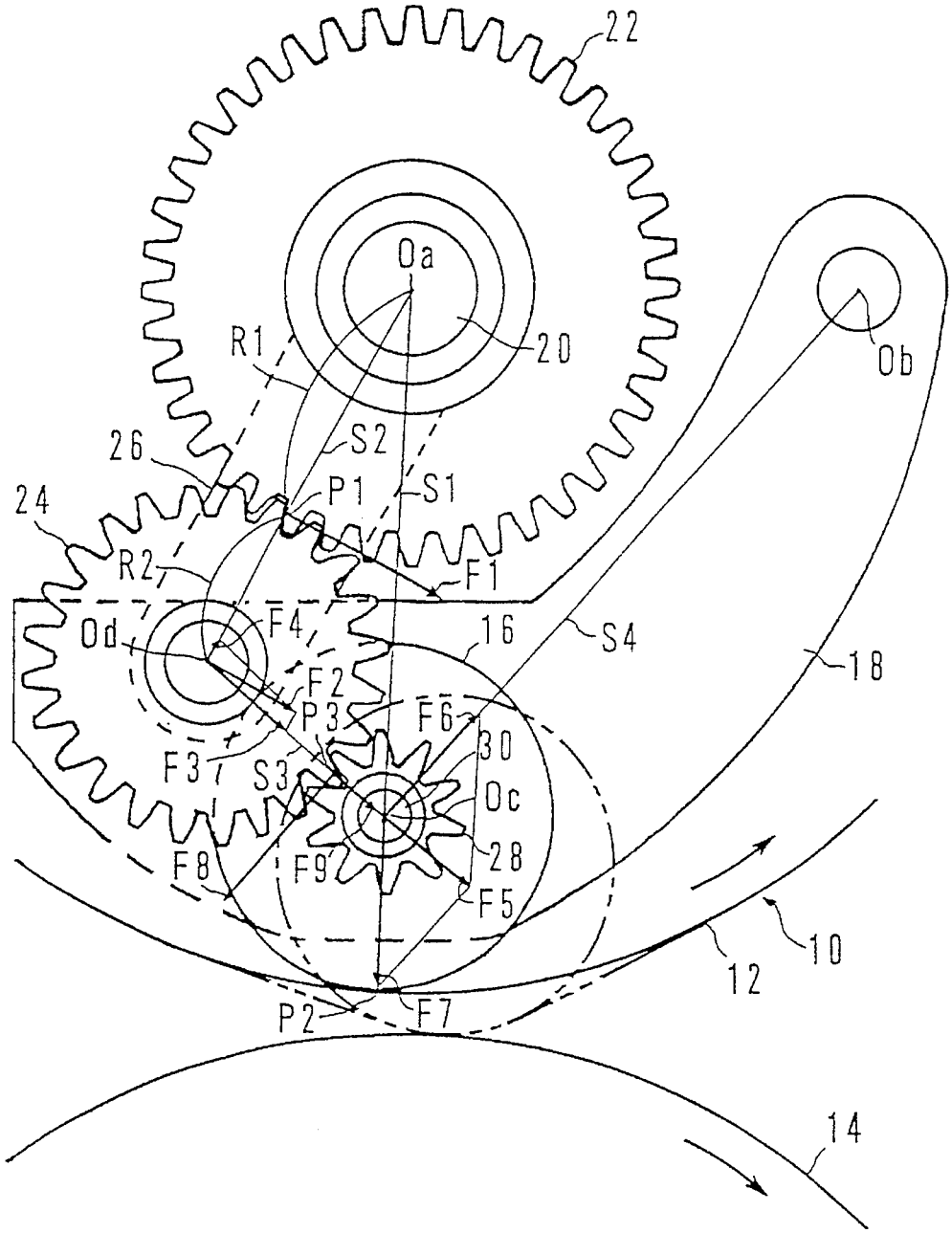
FIG. 1 is a diagrammatic view illustrating the functions and effects of the essential part of the invention of the rotary stencil printer when it incorporates a first or a second embodiment of the present invention.

First, the functions and effects of the essential part of the invention of the rotary stencil printer according to the present invention, i.e., the inner press roller operation system, will be described with reference to FIG. 1. FIG. 1 corresponds to a part of FIG. 3. Therefore, FIG. 3 and the corresponding side views FIGS. 4 and 5 should be referred to for understanding the positions which the respective portions shown in FIG. 1 occupy in the overall construction of the rotary stencil printer.

Referring to FIG. 1, 10 is a printing drum, and 12 is an ink permeable flexible circumferential wall of the printing drum. The ink permeable flexible circumferential wall may be made of a rectangular sheet of a net material woven or knitted from a wire material or a thin sheet formed with a large number of small openings, such a sheet being formed into a cylindrical shape. Although the leading and trailing end portions of the sheet curved into a cylindrical shape is slightly deviated from a strict cylindrical shape, such a body may be deemed to be a cylinder as a whole having a central axis perpendicular to the sheet of the drawing, passing through point Oa. Therefore, the cylindrical printing drum 10 is rotatable on the central axis Oa. 14 is a back press roller rotatable on its central axis not shown in the figure so as to oppose the circumferential wall 12 of the printing drum 10 at the outside thereof to be close thereto. The printing drum 10 and the back press roller 14 are rotated on the respective central axes in the directions shown by arrows in the figure, i.e. the printing drum 10 rotates counterclockwise, while the back press roller 14 is rotated clockwise, when printing is carried out. As a matter of course, the printing drum 10 and the back press roller 14 are rotatably supported by a frame body, not shown in the figure, of the rotary stencil printer.

At the inside of the printing drum 10 there is provided an inner press roller 16 so as to contact the circumferential wall 12 at the inside thereof and to press a corresponding part of the circumferential wall radially outward of the printing drum toward the back press roller 14. The inner press roller 16 is supported to be rotatable on a central axis Oc thereof by an arm means 18 supported by the frame body to swing about a pivot axis Ob which is parallel with and distant from the central axis Oa of the printing drum. The arm means 18 is a pair of arm members as depicted in a side view such as FIG. 4, carrying the inner press roller 16 at opposite axial ends thereof.

As the pivot axis Ob is in parallel with and distant from the central axis Oa of the printing drum, when the arm means 18 is at a first swing position as shown in FIG. 1, the inner press roller 16 is just in contact with the circumferential wall 12 of the printing drum, but when the arm means 18 swings therefrom slightly about the pivot axis Ob counterclockwise in the figure to come to a second swing position, the inner press roller 16 shifts to the position shown in the figure by a phantom line, and in accordance therewith a portion of the circumferential wall 12 of the printing drum opposing the back press roller 14 is biased radially outward of the printing drum as illustrated by a phantom line.

20 is a shaft for supporting the printing drum 10 to be rotatable around the central axis Oa. A first gear wheel 22 is provided to rotate on the central axis of the printing drum Oa in synchronization with the printing drum 10. Although in the embodiment described hereinbelow the gear wheel 22 is formed to be integral with the printing drum 10, the gear wheel 22 need not necessarily be integral with the printing drum 10 to carry out the present invention. Further, the gear wheel 22 need not necessarily be firmly mounted to the printing drum 10 so as to rotate in unison therewith, but the gear wheel 22 may be mounted on the printing drum support shaft 20 so as to be rotated in synchronization with the printing drum 10 at, however, a rotation speed different from that of the printing drum.

A second gear wheel 24 is provided to mesh with the gear wheel 22. The gear wheel 24 is supported to be rotatable on a central axis Od thereof by an arm means 26 mounted to swing about the central axis Oa of the printing drum. As the arm means 26 swings about the central axis Oa of the printing drum 10, the arm means 26 may be rotatably supported by the printing drum support shaft 20, as will be described hereinbelow with reference to FIGS. 4 and 5.

A third gear wheel 28 is provided to have a central axis coinciding with the central axis Oc of the inner press roller 16. The gear wheel 28 is connected with the inner press roller 16 to rotate together therewith, and therefore may be supported by a shaft 30 for supporting the inner press roller as firmly mounted thereto, as described hereinbelow with reference to FIGS. 4 and 5. The third gear wheel 28 meshes with the second gear wheel 24.

As will be apparent from FIG. 1, the central axis Od of the second gear wheel 24 is located on one side of a phantom plane S1 extended between the central axis Oa of the printing drum and the central axis Oc of the inner press roller 16 opposite to the other side thereof at which the pivot axis Ob of the arm means 18 is located.

In such a construction, when the printing drum 10 rotates counterclockwise as shown by the arrow and the gear 22 rotates in synchronization therewith in the same counterclockwise direction, the gear wheel 24 meshing with the gear wheel 22 rotates clockwise, and the gear wheel 28 meshing with the gear wheel 24 rotates counterclockwise. The inner press roller 16 rotates integrally with the gear wheel 28. In such a linkage between the printing drum 10 and the inner press roller 16 by the gear train, assuming that the gear wheel 22 rotates integrally with the printing drum 10, as in the shown embodiment, for the sake of simplicity, the direction of transmittance of force through the gear train differs according to the relationship between the ratio of diameter between the printing drum 10 and the inner press roller 16 and the acceleration gear ratio of the gear train.

In other words, when the diameter ratio of the printing drum to the inner press roller and the acceleration ratio of the gear train, i.e. the ratio of number of gear teeth of said first gear wheel 22 to said third gear wheel 28, are equal to one another, the gear train transmits no substantial force in either direction.

If the acceleration ratio is greater than the diameter ratio, since the outer circumferential surface of the inner press roller 16 moves faster than the circumferential wall 12 of the printing drum in the forward direction, the rotation of the inner press roller 16 is applied with a braking action from the circumferential wall of the printing drum, and therefore, there occurs a flow of force through the gear train from the gear wheel 22 toward the gear wheel 28. Therefore, the gear wheel 24 is applied with a force from the gear wheel 22 such as a force F1 acting at a contact point P1 of the two gear wheels and oriented perpendicular to a phantom plane S2 extended between the central axes Oa and Od (F1 is such a component of the force acting between tooth faces of the two meshing gear wheels that is perpendicular to the phantom plane S2. This is the same with respect to F8 described hereinbelow.). In the following description, for the sake of convenience, the actual three dimensional construction will be described as a two dimensional construction appearing in FIG. 1, denoting contact line P1, phantom plane S1, etc. as contact point P1, phantom line S1, etc. The force F1 acting at the contact point P1 corresponds to force F2 acting at the center Od of the gear wheel 24. The force F2 is perpendicular to the phantom line S2, and denoting the radius of the pitch circle of the gear wheel 22 as R1, and the radius of the pitch circle of the gear wheel 24 as R2, the magnitude of the force F2 is $F1 \times R1/(R1+R2)$. The force F2 acting to the gear wheel 24 at the center Od thereof is dividable into force F3 acting along a phantom line S3 connecting the center 0d of the gear wheel 24 and the center Oc of the gear wheel 28 and force F4 acting along the phantom line S2 within the arm means 26. The force F4 is supported as an internal stress of the arm means 26.

The force F3 is applied to the gear wheel 28 along the phantom line S3, to generate a force F5 acting at the center Oc of the gear wheel 28 along an extension of the phantom line S3 (F5=F3). This force F5 can be divided into a force F6 acting along a phantom line S4 connecting the pivot center Ob and the center Oc of the gear wheel 28 and a force F7 directed from the center Oc of the gear wheel 28 (i.e. the center of the inner press roller 16) toward the contact point P2 between the inner press roller 16 and the circumferential wall 12 the printing drum. Since the force F6 is supported as an internal stress acting in the arm means 18, the inner press roller 16 presses the corresponding part of the circumferential wall 12 of the printer radially outward by the force F7.

The gear wheel 28 is also applied with a force F8 acting in a common tangential direction of the pitch circles of the meshing gear wheels 24 and 28 according to the torque transmission from the gear wheel 24 to the gear wheel 28. Assuming that the gear wheel 24 is supported to be lightly rotatable by a conventional bearing means, the magnitude of the force F8 is equal to that of the force F1. Since the force F8 generates a rotational moment around the point Ob which is approximately equal to a product of the magnitude of F8 and the radius of the pitch circle of the gear wheel 28, assuming that the radius of the pitch circle of the gear wheel 28 is R3 (not shown in the figure) and the distance between the points Oc and Ob as L (not shown in the figure), the effect of this force is equivalent to that a force of a magnitude F8×R3/L is added to the force F5. This force can also be divided into two forces in the same manner as the force F5 is divided into F6 and F7, so that the force F7 is correspondingly increased, thereby increasing the force of the inner press roller 16 pressing the corresponding portion of the circumferential wall of the printing drum radially outward.

Further, since there exists a contact angle at the meshing point P3 of the contact between the tooth faces of the gear wheels 24 and 28, when the force F8 is generated along the common tangential line of the pitch circles of the two gear wheels, a force F9 is generated to have a magnitude of a product of the magnitude of F8 and "tan" of the pressure angle in the direction shown in the figure. Since this force F9 is also added to the force F5, the force of the inner press roller 16 pressing the circumferential wall 12 radially outward increases by a corresponding increment.

The above analysis is based upon the premise that the above-mentioned acceleration ratio is greater than the above-mentioned diameter ratio so that the rotation of the inner press roller 16 is braked by the printing drum 10. However, if the acceleration ratio is smaller than the diameter ratio, no braking action is applied to the inner press roller by the circumferential wall of the printing drum against the rotation of the inner press roller. Under such an inverted relationship between the acceleration ratio and the diameter ratio, the rotation of the inner press roller is accelerated by the circumferential wall of the printing drum, so that the direction of forces corresponding to F1, F8, etc. is inverted, and therefore, no effective force is available through the gear train for synchronizing the inner press roller with the printing drum to bias the inner press roller radially outward of the printing drum toward the back press roller.

In fact, however, the inner press roller 16 of this type also operates as a means for supplying ink to the circumferential wall 12 of the printing drum by carrying an ink layer on the outer circumferential surface thereof as it rotates, with said ink layer being formed by a provision of an ink supply port opening above the inner press roller and a squeeze rod arranged close to the outer circumferential surface of the inner press roller at an upper portion thereof along a generatrix of the outer circumferential surface, to form a wedge shaped ink deposit open at the bottom thereof to define an ink discharge slit through which the ink of the ink deposit is discharged as carried by on the outer circumferential surface of the inner press roller in the form of said ink layer, though not shown in the figure for the clarity of the illustration, and because such a construction is already well known in this art, and therefore, the supply of ink is brought to the asymptotic side of the two cylindrical surfaces of the inner press roller 16 and the circumferential wall 12 of the printing drum, i.e. the left side of the contact point (line) P2 therebetween as viewed in FIG. 1. Therefore, it brings about a substantial difference in the squeezing performance applied by the inner press roller 16 to the circumferential wall 12 of the printing drum under the simultaneous supply of ink whether the outer circumferential surface of the inner press roller 16 advances or delays relative to the circumferential wall 12 of the printing drum. Of course there are many cases where it is desirable that the outer circumferential surface of the inner press roller 16 delays relative to the circumferential wall 12 of the printing drum.

In view of the above, the present invention proposes to apply a controlled braking force to the rotation of the inner press roller 16 by providing a brake means between the gear wheel 28 (and therefore the inner press roller 16 rotating integrally therewith) and the arm means 18 which rotationally supports the gear wheel 28 (inner press roller 16), according to the first embodiment of the invention. When the braking action against the rotation of the gear wheel 28 (inner press roller 16) is applied by such a brake means, the braking action applied to the inner press roller 16 can be optionally controlled, so that the degree of pressing the circumferential wall 12 radially outward by the inner press roller 16 can be optionally controlled. On the other hand, the relative velocity between the inner press roller 16 and the circumferential wall 12 of the printing drum may be optionally determined exclusively from the view point of optimizing the squeezing action desired in the stencil printing. In other words, the relationship between the acceleration ratio and the diameter ratio may be optionally designed so that the outer circumferential surface of the inner press roller 16 advances at any relative speed against the inner surface of the circumferential wall 12 of the printing drum, or there is no relative speed therebetween, or the outer circumferential surface of the inner press roller delays at any relative speed against the inner surface of the circumferential wall 12 of the printing drum, to obtain a most desirable stencil printing.

Although the braking force was applied against the rotation of the gear wheel 28 (inner press roller 16) in the above-mentioned analysis, instead or in addition, a brake means may be provided between the gear wheel 24 and the arm means 26 so as to apply a braking force against the rotation of the gear wheel 24 relative to the arm means 26. By the rotation of the gear wheel 24 being braked by such a brake means, regardless whether the force F8 is generated or not, or even when the directions of the force F8 is reversed, the force F7 based upon the force F3 is generated in the same manner as described above, so that there is generated a force to press the inner press roller 16 against the circumferential wall 12 of the printing drum radially outward under a controlled condition effected by such a brake means.

Figure 2:
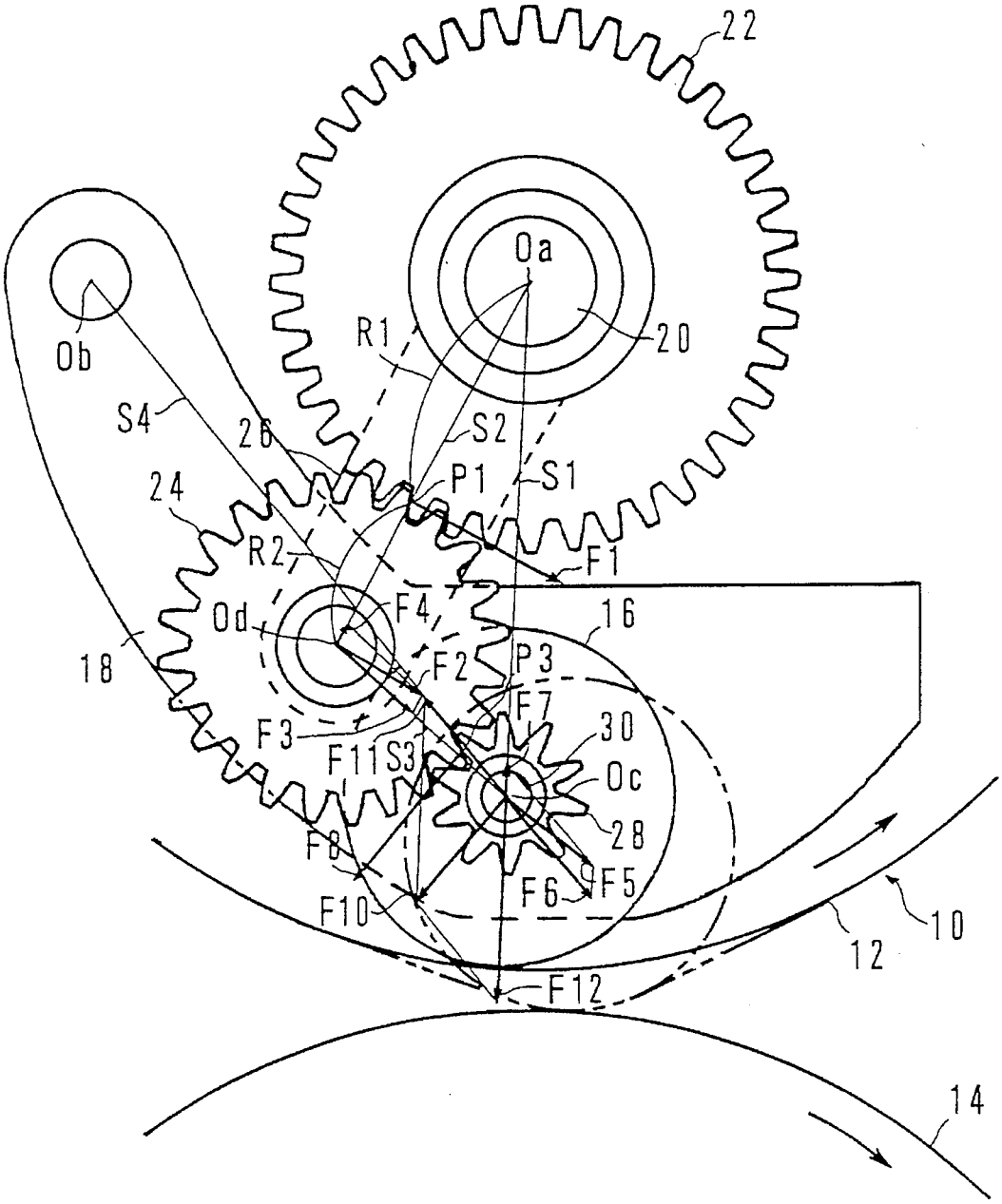
FIG. 2 is a diagrammatic view illustrating the functions and effects of the essential part of the invention of the rotary stencil printer when it incorporates a third embodiment of the present invention.

FIG. 2 is a view similar to FIG. 1, showing a construction in which the arrangement of the arm means 18 relative to the gear train is mirror reversed, so that the pivot axis Ob is located on a same side of the phantom line S1 connecting points Oa and Oc as the center Od of the gear wheel 24. Such construction and arrangement of the gear train and the arm means are the same as those shown in the above-mentioned Japanese Patent Laid-open Publication 3-254984. In FIG. 2, the portions corresponding to those shown in FIG. 1 are designated by the same reference numerals as in FIG. 1. Also in the construction of FIG. 2, when the rotation of the gear wheel 28 (inner press roller 16) is braked, the force F1 generates the corresponding forces F2 and F3, pressing the gear wheel 24 to the gear wheel 28, so that the force F5 is applied to the center Oc of the gear wheel 28. In this case, however, particularly in the design shown in the figure, when the force F5 is divided into a force F6 acting along the phantom line S4 and the force F7 acting along the phantom line S1, the force F7 is directed upward in the figure, such that force F7 acts to remove the inner press roller 16 away from the circumferential wall 12 of the printing drum radially inward. (In the construction of FIG. 2, regardless of a small change of the design, the force F7 will never generate a substantial force directed downward.) In this case, however, if the gear wheel 28 (inner press roller 16) is braked, the force F8 corresponding to the force F1 is substantially increased, so that a force F10 which acts at the center Oc of the gear wheel 28 in accordance with the force F8 is divided into a force F11 acting along a phantom line S4 and a force F12 acting along the phantom line S1 to press the inner press roller 16 against the circumferential wall 12 of the printing drum radially outward, and since the force F12 is substantially greater than the force F7 acting at the center Oc upward in the figure, the provision of the brake means for braking the rotation of the gear wheel 28 (inner press roller 16) against the arm means 18 provides the function of pressing the inner press roller 16 against the circumferential wall 12 of the printing drum radially outward at a force controllable by the control of the braking force of the brake means.

In the construction of FIG. 2, if no brake means is provided for the gear wheel 28 (inner press roller 16), and only the brake means for braking the rotation of the gear wheel 24 against the arm means 26 is provided, since no substantial force F8 is generated, there is obtained no substantially effective function of pressing the inner press roller 16 to the circumferential wall 12 of the printing drum radially outward.

As will be apparent from the above descriptions, in either of the constructions shown in FIGS. 1 and 2, the force of the inner press roller 16 pressing the circumferential wall 12 of the printing drum radially outward is optionally controlled by controlling the braking action applied to either the gear wheel 28 or 24 or both. Thus, by appropriately controlling the magnitude of the braking action applied to either of the above-mentioned gear wheels, the gear train for synchronizing the inner press roller to the circumferential speed of the printing drum is effectively utilized to optionally control the degree of pressing the inner press roller against the circumferential wall of the printing drum.

Since there acts between the gear wheels 24 and 28 the force F9 along the phantom line S3 connecting the centers Od and Oc of the two gear wheels to repulse one from the other due to the pressure angle at the meshing point, when the pressure angle of gear meshing between these two gear wheels is large and the friction coefficient between the two mutually meshing tooth faces is low, the two gear wheels will be relatively displaced from one another from the designed meshing condition so far that the meshing between the two gear wheels becomes too shallow or the meshing is disengaged. If such an instability of meshing occurs, the uniformity of the thickness of printing image will be lost. In this regard, if there is provided a means to restrict the distance between the central axes of the gear wheels 24 and 28 not to increase beyond a predetermined distance, such a relative displacement of the two gears wheels toward disengagement of meshing is definitely suppressed, so that a stabilized thickness of printed image is ensured.

Further, when the braking force applied to either of the above-mentioned gear wheels is temporarily increased during the starting of the printing operation, the inner press roller is more strongly pressed against the circumferential wall of the printing drum during the starting time at which there is a tendency that the printed image is thinner because of the delay of supply of the ink, so that a normally thick print image is available from the very beginning of the printing operation.

In the following, the rotary stencil printer of the present invention incorporating the inner press roller operation system described with reference to FIG. 1 will be described with respect to some embodiments thereof with reference to FIGS. 3–8. In these figures, the portions corresponding to those shown in FIG. 1 are designated by the same reference numerals as in FIG. 1. In this connection, it is to be noted that in FIGS. 4 and 5 the rotational phase of the printing drum 10 is shifted 180° from that shown in FIG. 3 for the clarity of illustration.

Figure 3:
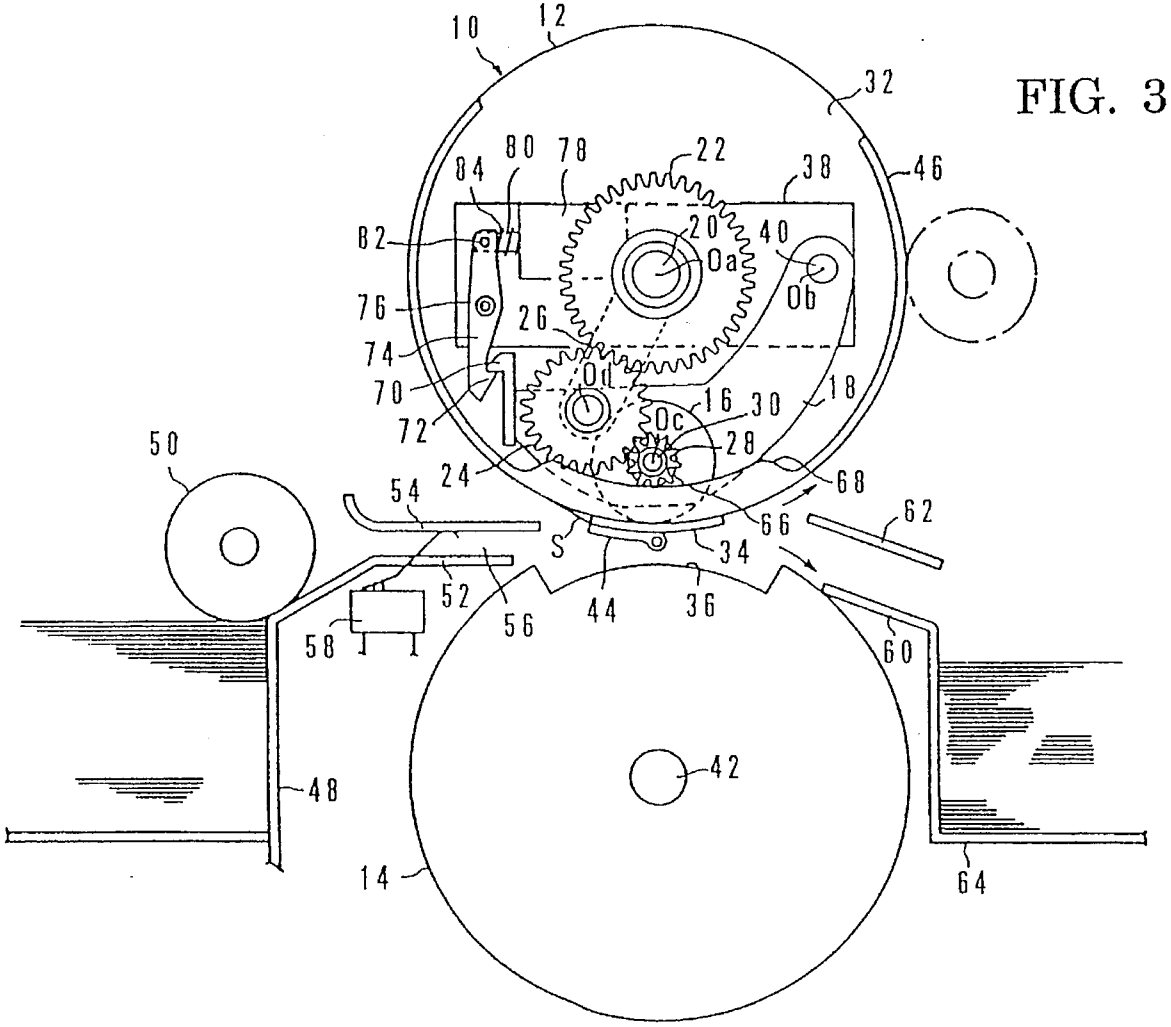
FIG. 3 is a somewhat diagrammatic front view showing the rotary stencil printer when it incorporates said first or said second embodiment.
Figure 4:
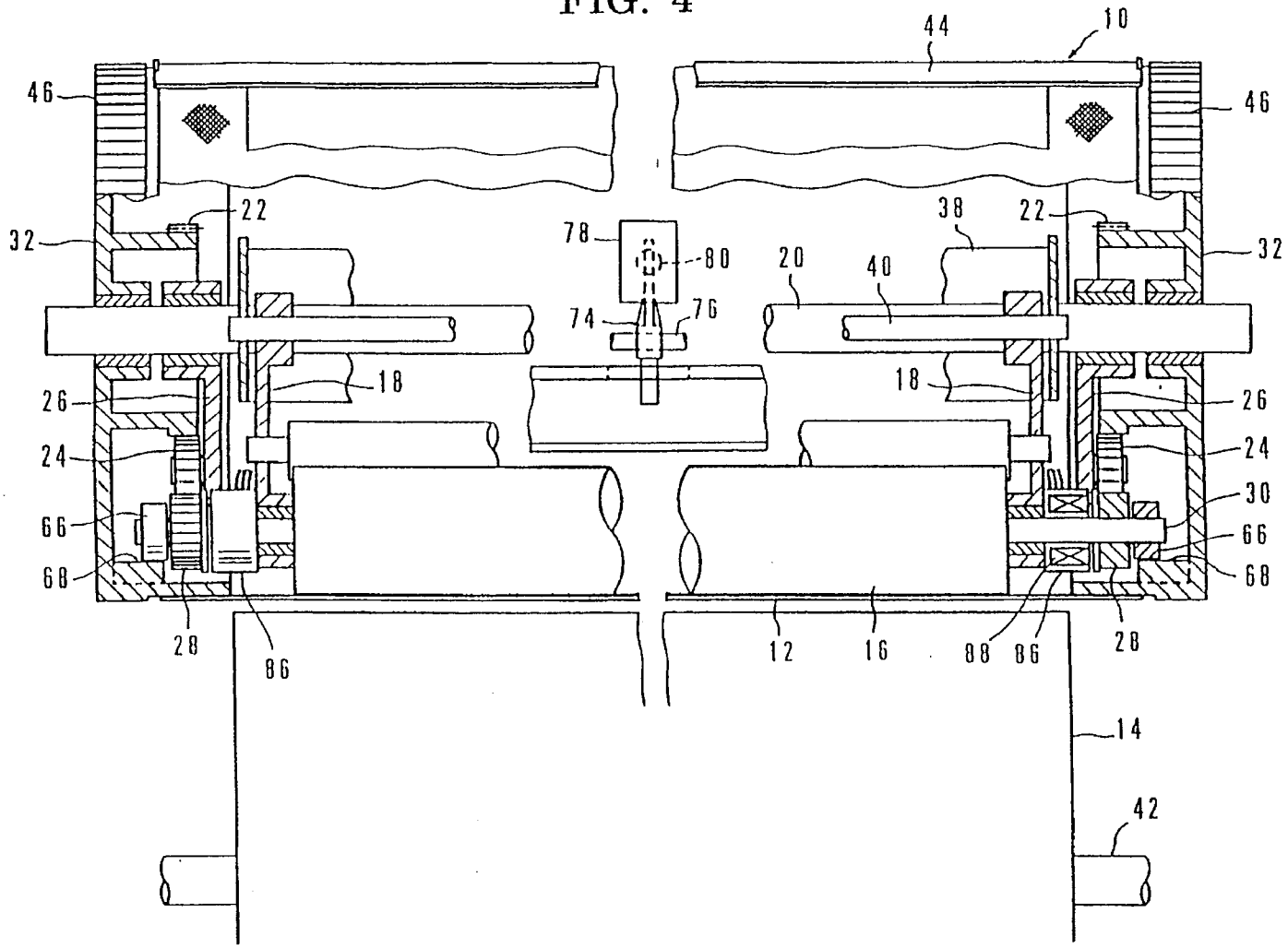
FIG. 4 is a somewhat diagrammatic side view of the rotary stencil printer shown in FIG. 3 when it incorporates said first embodiment.
Figure 5:
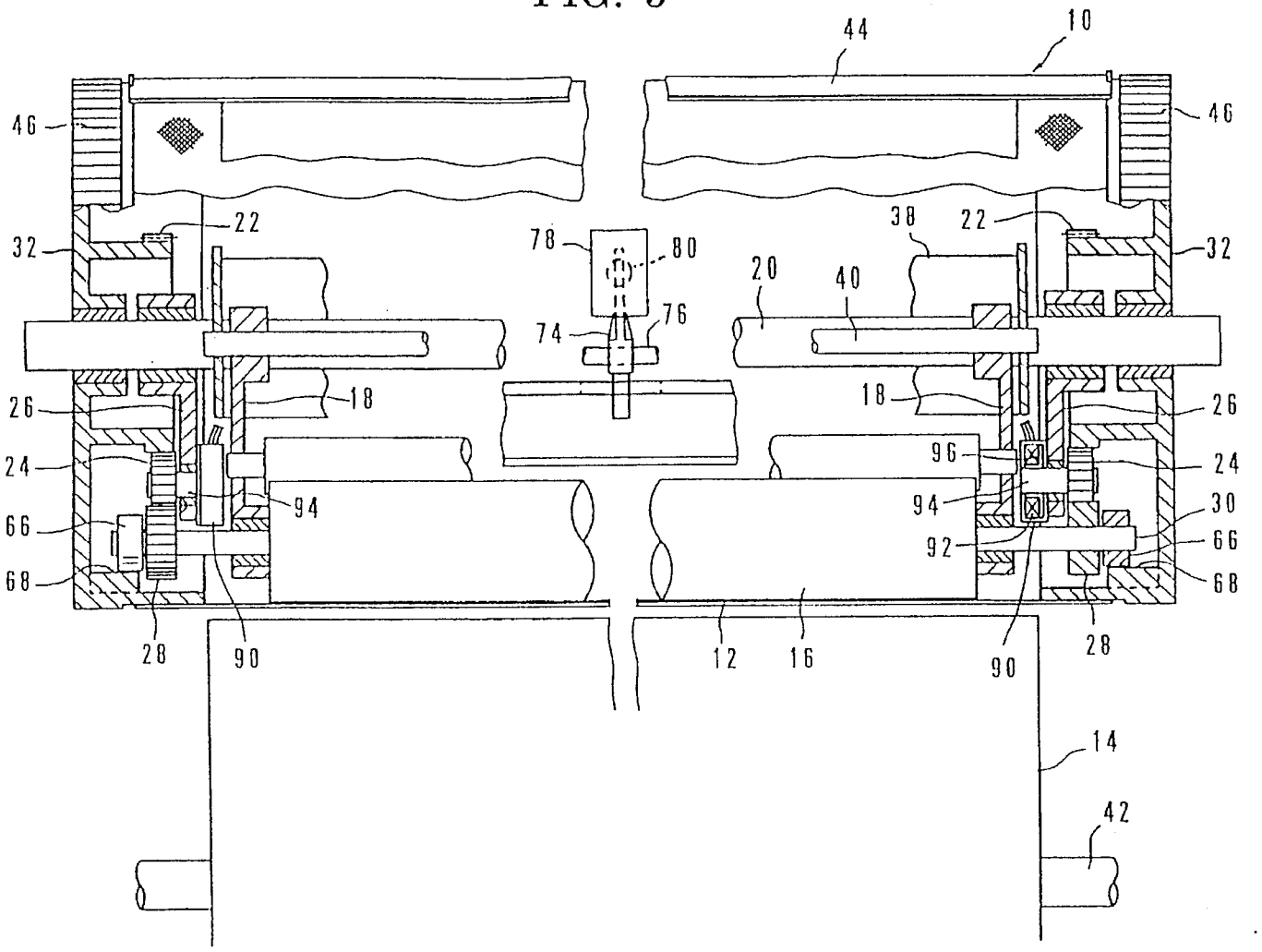
FIG. 5 is a somewhat diagrammatic side view of the rotary stencil printer shown in FIG. 3 when it incorporates said second embodiment.

Referring to FIGS. 3–5, 10 is a printing drum and 12 is an ink permeable flexible circumferential wall of the printing drum. As already described, such a flexible circumferential wall is formed of a rectangular sheet of a woven or knitted material made of a wire material or a thin sheet material formed with a number of small openings. The rectangular sheet is formed into a cylindrical body with opposite edge portions thereof being seated along the periphery of a pair of disk members 32. The leading end of the sheet is mounted to a transverse bar means 34 bridging the pair of disk members 32 along a generatrix of the cylindrical body. The trailing end portion of the sheet is either freely inserted into a space formed between the outer circumferential surface of the pair of disk members 32 and the transverse bar means 34 or biased in the inserted position by spring means not shown in the figure. Such a construction of the printing drum may be the same as shown in the above-mentioned Japanese Patent Laid-open Publications 1-204781 and 2-225078, and does not relate to the gist of the present invention. 14 is a back press roller positioned close to the circumferential wall 12 of the printing drum at the outside thereof. The back press roller 14 is formed with a transverse groove 36 indented from the outer circumferential surface thereof so that, when the printing drum 10 and the back press roller 14 are rotated in opposite direction in synchronization with one another, the transverse bar means 34 of the printing drum meets with and received in the transverse groove 36. An inner press roller 16 is provided in the printing drum 10 so as to contact the circumferential wall 12 of the printing drum at the inside thereof to press a part of the circumferential wall radially outward toward the back press roller 14. The inner press roller 16 is supported to be rotatable on a central axis Oc thereof by an arm means 18 adapted to swing about a pivot axis Ob parallel with and distant from the central axis Oa of the printing drum. As shown in FIGS. 4 and 5, the arm means 18 is provided as a pair of arm members supported by an arm member support shaft 40 which is supported by an inner frame 38 supported by the printing drum support shaft 20 as mounted in an inner space of the printing drum 10. The printing drum support shaft 20 is a non rotatable shaft supported by a frame body of the stencil printer not shown in the figure. The back press roller 14 is also supported by a back press roller support shaft 42 which is supported by the frame body not shown in the figure.

A first gear wheel 22 is provided so as to rotate around the central axis Oa of the printing drum in synchronization therewith. In the shown embodiment, a pair of gear wheels 22 are provided at opposite axial ends of the printing drum as an integral part of the pair of disk members 32 forming the opposite axial ends of the printing drum, so that the gear wheels 22 rotate together with the printing drum.

A second gear wheel 24 meshing with the gear wheel 22 is provided as supported by an arm means 26 to be rotatable on a central axis Od thereof, the arm means 26 being adapted to swing about the central axis Oa of the printing drum. The gear wheel 24 and the arm means 26 are both provided as a pair of gear wheels and a pair of arm members. The pair of arm members are rotatably mounted on the printing drum support shafts 20 at one end portion thereof.

A third gear wheel 28 having a central axis coinciding with the central axis Oc of the inner press roller 16 is provided so as to rotate together with the inner press roller 16. The gear wheel 28 is also provided as a pair of gear wheels supported by the pair of arm members 18 via an inner press roller support shaft 30. The pair of gear wheels 28 are fixedly mounted on the inner press roller support shaft 30 in a torque transmitting relationship. Therefore, the pair of gear wheels 28 rotate with the inner press roller 16 in unison via the inner press roller support shaft 30. The pair of gear wheels 28 are meshed with the corresponding gear wheels 24.

On the transverse bar means 24 of the printing drum there is provided a clamp 44 for attaching the leading end of a stencil so that a perforated stencil S is mounted around the circumferential wall 12 of the printing drum from its leading end to its trailing end, with the leading end being held on the transverse bar means 24 as fastened thereto by the clamp 44. The printing drum 12 and the back press roller 14 are functionally engaged by a linking mechanism not shown in the figure so that they are rotated in mutually opposite directions, i.e. the printing drum 12 rotates counterclockwise, while the back press roller 14 rotates clockwise, both viewed in FIG. 3. Tooth portions 46 of gear wheels formed around peripheries of opposite end portions of the printing drum shown in FIGS. 4 and 5 constitute a part of such a linking mechanism.

When the printing drum 10 and the back press roller 14 rotate from the position shown in FIG. 3 for a small angle in the direction shown by arrows so that the outer circumferential surface of the back press roller 14 opposes the circumferential wall 12 of the printing drum at a portion thereof not formed with the transverse groove 36, there remains a small clearance of the order of several millimeters between the printing drum and the back press roller in the condition that the circumferential wall 12 of the printing drum is not pressed radially outward by the inner press roller 16, said small space providing a nip region between the printing drum and the back press roller for nipping and transferring a print sheet for printing. In order to feed a print sheet into the nip region from the left side in FIG. 3, there is provided a stencil sheet supply means including a print sheet supply tray 48, a print sheet feed roller 50, guide means 52 and 54 defining a print sheet supply passage 56, and a print sheet supply sensor 58 for detecting whether or not a print sheet is supplied to the print sheet supply passage. Such a print sheet supply means is known in various constructions and does not form any essential part of the present invention.

When the printing drum 10 and the back press roller 14 rotate in the respective rotational directions shown by the arrows in FIG. 3 with a part of the circumferential wall 12 0f the printing drum being continually pressed radially outward by the inner press roller 16 toward the back press roller 14 at the nip region, while a print sheet is supplied from the above-mentioned print sheet supply means and is fed into the nip region so as to be pressed between the stencil S mounted around the circumferential wall 12 of the printing drum and the back press roller 14, ink is supplied as a thin uniform layer to the outer circumferential surface of the inner press roller 16 from an ink supply means (not shown in the figure for the clarity of illustration, as such an ink supply means is already known in various constructions), so that the ink passes through the ink permeable circumferential wall 12 of the printing drum and further through and the perforated portions of the stencil S so as to be transferred onto the printing sheet. Such a stencil printing mechanism is described in the above-mentioned Japanese Patent Laid-open Publications 1-204781 and 2-225078, although such a stencil printing mechanism is well known in the art. The print sheet thus applied with a stencil printing is transferred through a print sheet discharge means diagrammatically shown by print sheet guide means 60 and 62 to be finally received in a print tray 64.

In order to avoid that the inner press roller 16 bumps against the transverse bar means 34 and to sustain it from supplying ink to the leading and trailing end portions of the stencil so that undesirable leakage of ink at these portions is avoided, while the inner press roller 16 can be pressed against the circumferential wall 12 of the printing drum radially outward only in the substantial printing region excluding the leading and trailing end portions of the stencil, a pair of rollers 66 are rotatably mounted at opposite ends of the inner press roller support shaft 30, and corresponding thereto there are provided a pair of cams 68 at the pair of disk portions 32 of the printing drum. By the engagement of the cams 68 and the rollers 66, as will be apparent from the profile of the cams 68 appearing in FIG. 3, the inner press roller 16 is retained within a radial region not to press the circumferential wall of the printing drum radially outward beyond the natural cylindrical shape thereof in the angular region including the transverse bar means 34, while allowing the inner press roller 16 to press the circumferential wall 12 radially outward in other region thereof.

A hook 70 is provided at a free end portion of the arm means 18, while a lever member 74 having a hook end 72 adapted to engage with the hook 70 is pivotably mounted to an inner frame member 38 by a pivot shaft 76. A solenoid 78 is mounted to the inner frame 38, and the armature 80 of the solenoid is pivotably connected at an end thereof with the other end of the lever member 74 by a pivot shaft 82. The lever member 74 is normally biased around the pivot axis 76 by a compression coil spring 84 counterclockwise as viewed in FIG. 3, so that when the lever member 74 is biased to the swing position shown in FIG. 3, whenever the rollers 66 have once climbed on the cams 68, the hook 70 provided at the end portion of the arm means 18 is engaged by the hook end 72, so that thereafter the inner press roller 16 is retained in the radial region not to deform the natural cylindrical shape of the circumferential wall 12 of the printing drum even when the rollers 66 disengage from the cams 68, so that, only when the solenoid 78 is energized, the lever member 74 is swung about the pivot axis 76 clockwise in FIG. 3, so as thereby to disengage the hook end 72 from the hook 70, so as thereby to allow the arm means 18 to swing about the pivot axis Ob counterclockwise in FIG. 3.

The constructions described up to here are similar to those described in the above-mentioned Japanese Patent Laid-open Publication 3-254984, although in the constructions of the present application the pivot axis Ob of the arm means 18 is located on one side of the above-mentioned phantom plane S1 extended between the central axis Oa of the printing drum. 10 and the central axis Oc of the inner press roller 16 opposite to the other side thereof at which the central axis Od of the gear wheel 24 is located.

In addition, according to the present invention, in order to accomplish the functions and effects described with reference to FIGS. 1 and 2, in the embodiment shown in FIG. 4, there is provided an electromagnetic brake 86 for braking the rotation of the unitary rotational body of the gear wheel 28 and the inner press roller 16 at a controlled braking force. The electromagnetic brake 86 is provided as a pair. When its solenoid 88 is supplied with an electric current, a friction member for braking is pressed against an annular brake surface provided on one side of the gear wheel 28 at a pressing force corresponding to the magnitude of the electric current, so that the rotation of the gear wheel 28 is correspondingly braked against the arm means 18. By a controlled braking action being applied against the rotation of the unitary rotational body of the gear wheel 28 and the inner press roller 16 by an optional operation of the brakes 86, regardless of the direction and the strength of the squeezing action applied to the circumferential wall 12 of the printing drum by the inner press roller 16, the pressing out amount of and the pressing out force applied to the circumferential wall 12 of the printing drum by the inner press roller 16 are optionally controlled, as described with reference to FIG. 1.

FIG. 5 is a view similar to FIG. 4, showing a second embodiment of the present invention. In FIG. 5, the portions corresponding to those shown in FIG. 4 are designated by the same reference numerals as in FIG. 4. In this construction, there is provided an electromagnetic brake 90 for selectively braking the rotation of the gear wheel 24 against the arm means 26. The electromagnetic brake 90 is also provided as a pair so that each of the pair acts at each of the pair of gear wheels 24. The electromagnetic brake 90 has a solenoid 92 mounted to and supported from the arm means 26, a shaft 94 for rotationally mounting the gear wheel 24 to the arm means 26, and a disk 96 torque transmittingly connected with the shaft 94, and applies a braking force to the gear wheel 24 via the disk 96 according to the magnitude of an electric current supplied to the solenoid 92. By the magnitude of the braking action applied by the electromagnetic brake 90 to the gear wheel 24 against the rotation thereof relative to the arm means 26 being selectively controlled, the magnitude and the force of the pressing out of the circumferential wall 12 of the printing drum radially outward by the inner press roller 16 is appropriately controlled, as described with reference to FIG. 1.

In the construction of FIG. 4, i.e. in the construction where the rotation of the unitary rotational body of the gear wheel 28 and the inner press roller 16 is braked against the arm means 18 by the brake means 86, even when the pivot axis Ob of the arm means 18 and the central axis Od of the gear wheel 24 are positioned on the same side with respect to the phantom plane S1 extended between the central axis Oa of the printing drum 10 and the central axis Oc of the inner press roller 16 as shown in FIG. 2, the controlled braking operation of the brake means 86 can appropriately control the magnitude and the force of the radially outward pressing out of the circumferential wall 12 of the printing drum by the inner press roller 16, regardless of setting of the direction and magnitude of the squeezing action applied to the circumferential wall 12 of the printing drum by the inner press roller 16, as described with reference to FIG. 1.

Figure 6:
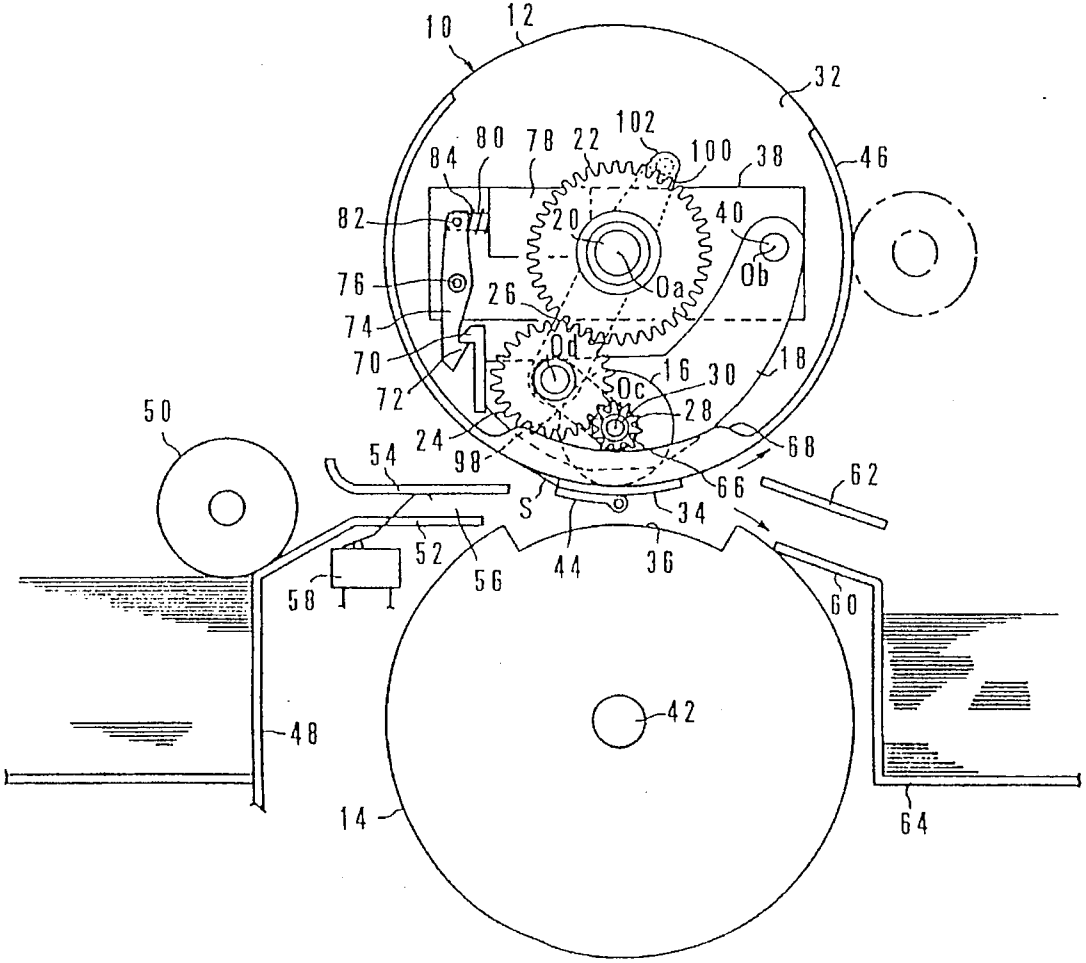
FIG. 6 is a somewhat diagrammatic front view similar to FIG. 3, showing a modification of the embodiment shown in FIG. 3.
Figure 7:
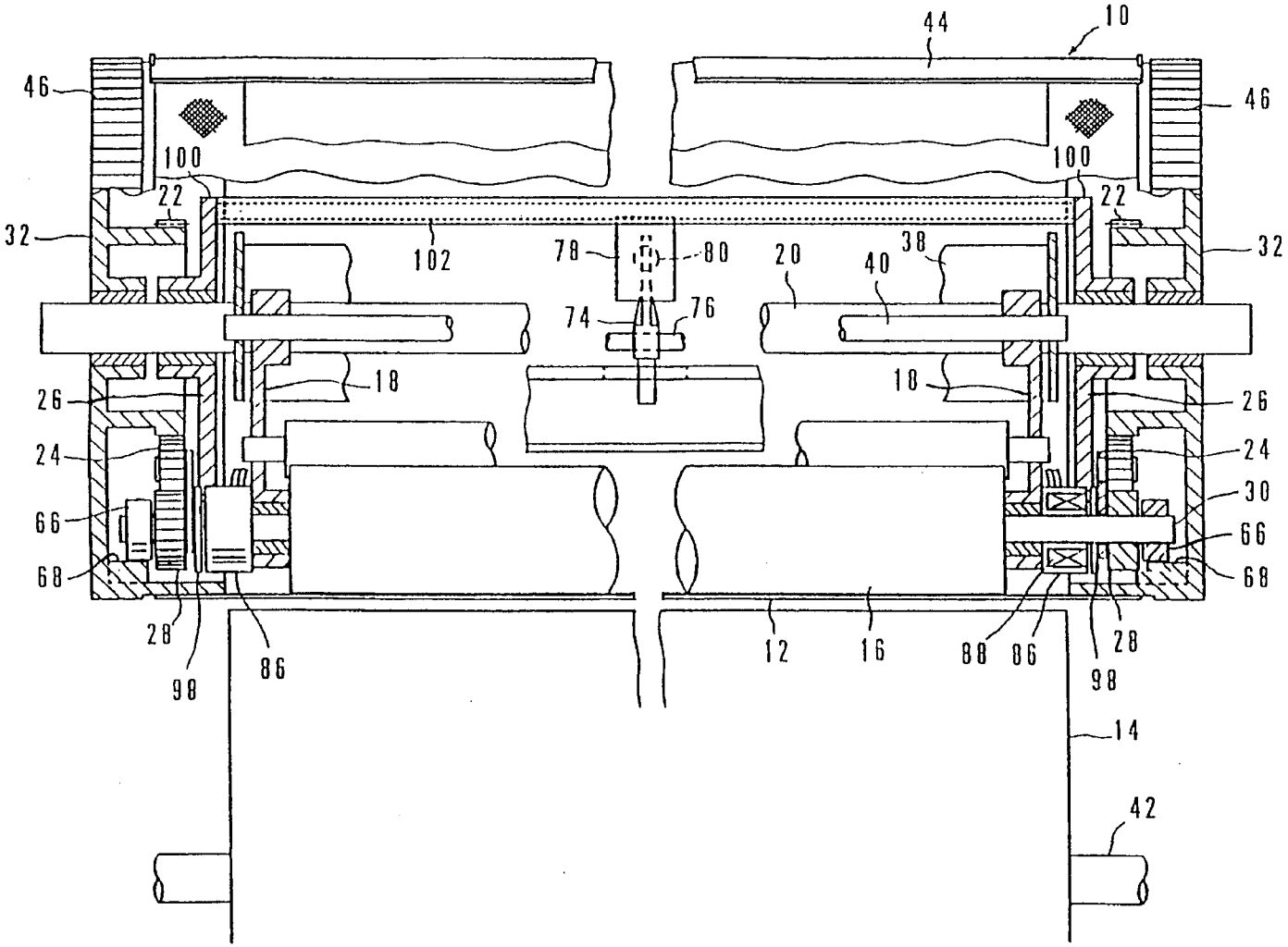
FIG. 7 is a somewhat diagrammatic side view similar to FIG. 4, corresponding to FIG. 6.
Figure 8:
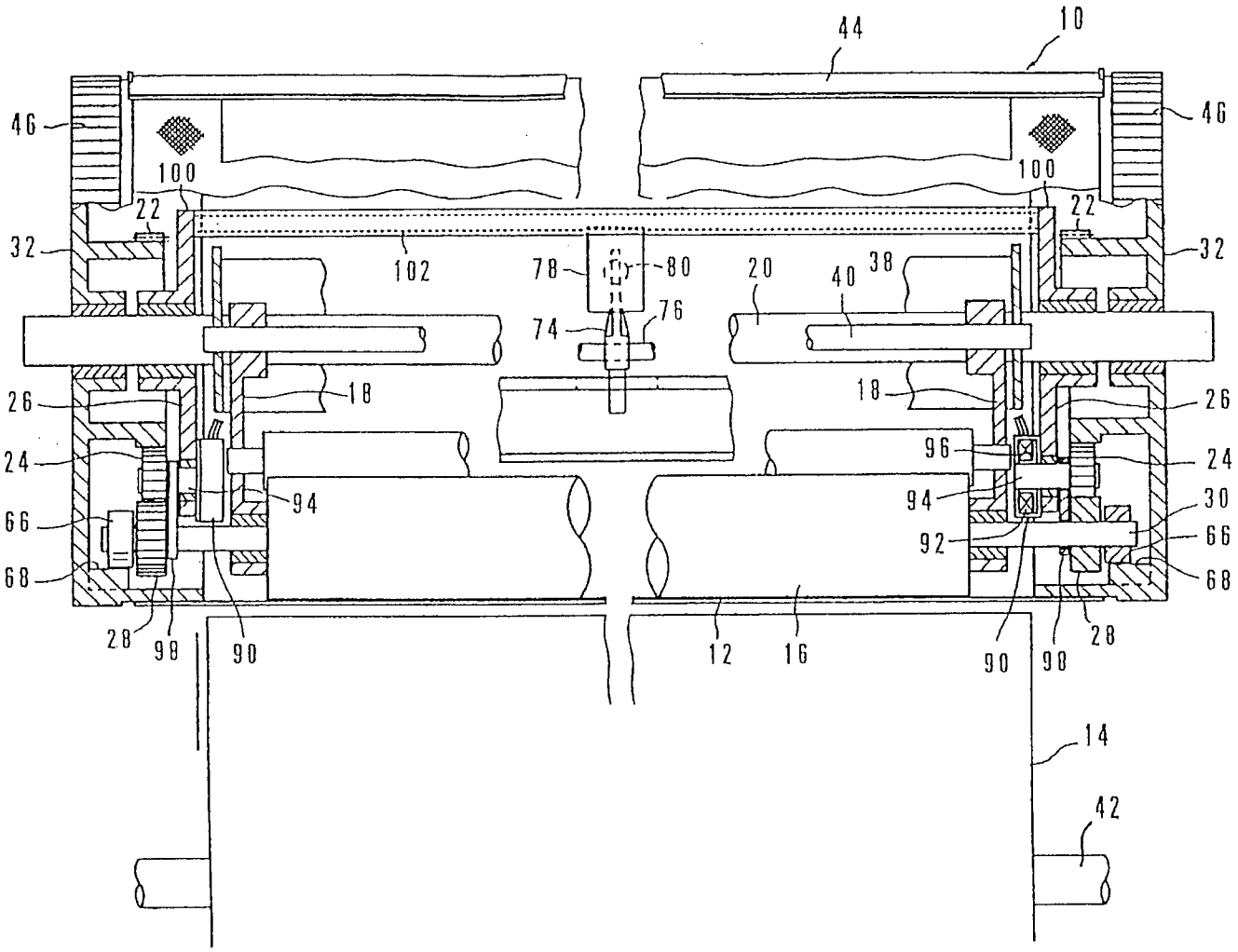
FIG. 8 is a somewhat diagrammatic side view similar to FIG. 5, corresponding to FIG. 6.

FIGS. 6–8 are views similar to FIGS. 3–5, showing small modifications of the embodiments shown in FIGS. 3–5. In FIGS. 6–8, the portions corresponding to those shown in FIGS. 3–5 are designated by the same reference numerals as in FIGS. 3–5. In the embodiment shown in FIGS. 6–8, a means is provided for restricting the distance between the central axes of the gear wheels 24 and 28 from increasing beyond a distance value required for a predetermined normal meshing between these two gear wheels. In the shown embodiment the means is constructed as a link 98 bridged between the shafts of the gear wheels 24 and 28. The link 98 is an elongated plate element having openings at opposite end portions thereof for receiving corresponding portions of the shafts of the gear wheels 24 and 28 in a manner that those shafts are passed through the openings of the link at the corresponding portion. By this link means the force F9 generated from the force F8 based upon the driving torque acting between the gear wheels 24 and 28 and the pressure angle in the meshing of the two gear wheels to have the effect of repulsing the two gear wheels apart from one another is conquered not to cause any increase of the distance between the central axis of the two meshing gear wheels beyond a predetermined distance value, so that the meshing of the two gear wheels is maintained in a stabilized condition. The portions at which the shafts of the gear wheels 24 and 28 engage the openings of the link may be any optionally portions along the shafts. As a modification, the link may have an opening which receives the gear wheel at the outer circumference thereof. Further, at least one of the two openings of the link 98 may be formed as an elongated opening or a round opening having a diameter larger than the corresponding portion of the shaft passed therethrough so that the generation of the force F9 from the force F8 is not obstructed.

Although the link 98 is somewhat diagrammatically shown in FIGS. 6–8 as other construction members, the link 98 may be constructed such that it is made of two parts joined together along a phantom plane extended between the central axes of the two bearing openings for receiving the two shafts and clamped together by bolts, or opposite end portions of the link are made of separate members which are removably clamped by bolts to a central portion so that the bearing opening can be released for mounting the respective end portions of the two shafts of the gear wheels. Since such a construction for relapsing a bearing bore for the purpose of assembling and disassembling is well known in the art of the connecting rod of engine, no further detail is shown in the figure to avoid complexity of the illustration. Further, in view of the function of the link, the link 98 may be replaced by an endless belt mounted around the two shafts of the gear wheels.

Further, in the embodiment shown in FIGS. 6–8, a pair of arm members 26 supporting a pair of gear wheels 24 are constructed to have integrally extended arm portions 100 and are firmly assembled with a connecting bar 102, so as to swing as an integral body about the pivot axis Oa, so that the pressing force applied to the opposite ends of the inner press roller from the pair of gear wheels 24 through the gear wheels 28 is uniformalized, so that the inner press roller is pressed outward uniformly over the whole width thereof.

It will be apparent that the embodiments shown in FIGS. 4 and 7 may be constructed to incorporate the inner press roller operation system shown in FIG. 2.

Although the present invention has been described in detail with respect to some preferred embodiments thereof, it will be apparent for those skilled in the art that various modifications are possible within the scope of the present invention.

We claim:

1. A method of controlling a rotary stencil printer including brake means for braking rotation of at least one gear wheel disposed on a supporting arm so that a reaction torque generated by actuation of the brake means generates a biasing force to bias an inner press roller in a radially outwardly direction of a printing drum, comprising the steps of:

applying a first braking force to the at least one gear wheel during a start-up phase of a printing operation; and applying a second braking force to the at least one gear wheel after the start-up phase of the printing operation whereby the second braking force is less than the first braking force.

2. A rotary stencil printer including brake means for braking rotation of at least one gear wheel disposed on a supporting arm so that a reaction torque generated by actuation of the brake means generates a biasing force to bias an inner press roller in a radially outwardly direction of a printing drum, comprising:

means for applying a first braking force to the at least one gear wheel during a start-up phase of a printing operation; and means for applying a second braking force to the at least one gear wheel after the start-up phase of the printing operation whereby the second braking force is less than the first braking force.

3. A rotary stencil printer comprising:

a frame body;

a printing drum having a circumferential wall made of an ink permeable flexible sheet material and supported by the frame body to be rotatable on a central axis thereof;

a back press roller having a cylindrical outer surface and supported by the frame body to be rotatable on a central axis thereof parallel with the central axis of the printing drum so as to define a nip region between the cylindrical outer surface thereof and a cylindrical outer surface of the printing drum for nipping and transferring a print sheet therethrough;

a first arm means supported by the frame body to swing about a pivot axis thereof parallel with and distant from the central axis of the printing drum;

an inner press roller supported by said first arm means to be rotatable on a central axis thereof parallel with and distant from the pivot axis of said first arm means to contact a part of the circumferential wall of the printing drum at a radially inside surface thereof so as to selectively press said part radially outward of the printing drum toward the back press roller when biased in a radially outward direction of the printing drum;

a first gear wheel adapted to rotate on the central axis of the printing drum in synchronization with the printing drum;

a second arm means adapted to swing about the central axis of the printing drum;

a second gear wheel supported by said second arm means to be rotatable on a central axis thereof and meshing with said first gear wheel;

a third gear wheel adapted to rotate on the central axis of the inner press roller together therewith and meshing with said second gear wheel so that the inner press roller is rotated in synchronization with the printing drum through a gear train of said first, second and third gear wheels when the printing drum is driven to rotate on the central axis thereof; and a brake means for braking rotation of at least one of said second and third gear wheels against the corresponding supporting arm means so that a reaction torque generated by an actuation of the brake means generates a force to bias the inner press roller in said radially outward direction of the printing drum.

4. A rotary stencil printer according to claim 1, wherein the central axis of said second gear wheel is located on a first side of a phantom plane extended between the central axes of the printing drum and the inner press roller opposite to a second side thereof at which the pivot axis of said first arm means is located.

5. A rotary stencil printer according to claim 1, wherein the central axis of said second gear wheel is located on a same side of a phantom plane extended between the central axes of the printing drum and the inner press roller as the pivot axis of said first arm means, and said brake means brakes the rotation of said third gear wheel.

6. A rotary stencil printer according to claim 1, further comprising a means for restricting a distance between the central axes of said second and third gear wheels from increasing beyond a predetermined distance to ensure a designed meshing therebetween.

7. A rotary stencil printer according to claim 1, wherein said third gear wheel is provided as a pair of gear wheels at opposite ends of the inner press roller, and said first and second gear wheels and said first and second arm means are each provided as a pair corresponding to said third gear wheels, wherein means are provided to connect each pair of said pairs of first and second arm means with one another so that each pair of said pairs of first and second arm means swing together about the corresponding pivot axis.

* * * * *